US007537129B2

(12) United States Patent
Bayss et al.

(10) Patent No.: US 7,537,129 B2
(45) Date of Patent: May 26, 2009

(54) LID FOR A DISPOSABLE BEVERAGE CONTAINER

(75) Inventors: George Leonard Bayss, Randwick (AU); Marcel Miller, Woolloomooloo (AU)

(73) Assignee: Noshmell Pty Ltd, Woolloomooloo, New South Wales (AU)

( * ) Notice: Subject to any disclaimer, the term of this patent is extended or adjusted under 35 U.S.C. 154(b) by 612 days.

(21) Appl. No.: 10/466,032

(22) PCT Filed: Jan. 11, 2002

(86) PCT No.: PCT/AU02/00029

§ 371 (c)(1), (2), (4) Date: Dec. 1, 2003

(87) PCT Pub. No.: WO02/055405

PCT Pub. Date: Jul. 18, 2002

(65) Prior Publication Data

US 2004/0076777 A1 Apr. 22, 2004

(30) Foreign Application Priority Data

| | | |
|---|---|---|
| Jan. 12, 2001 | (AU) | PR2489 |
| Apr. 20, 2001 | (AU) | PR4510 |
| Apr. 25, 2001 | (AU) | PR4555 |
| Jun. 14, 2001 | (AU) | PR5647 |

(51) Int. Cl.

| | |
|---|---|
| ***B65D 39/00*** | (2006.01) |
| ***B65D 43/00*** | (2006.01) |
| ***G01N 31/22*** | (2006.01) |
| ***G01K 3/00*** | (2006.01) |
| ***G01K 11/00*** | (2006.01) |

(52) U.S. Cl. ..... 215/230; 116/216; 428/34.1; 422/58; 374/110; 374/159; 374/161; 374/162

(58) Field of Classification Search ..... 374/110, 374/150, 151, 159, 161, 162; 428/34.1; 422/58; 116/216, 207; 215/230

See application file for complete search history.

(56) References Cited

U.S. PATENT DOCUMENTS

| | | | | |
|---|---|---|---|---|
| 4,919,983 | A | 4/1990 | Fremin | |
| 5,720,555 | A | 2/1998 | Elele | |
| 6,571,975 | B1 * | 6/2003 | Fay | 220/379 |
| 6,579,006 | B1 * | 6/2003 | Pariseau | 374/162 |
| 6,634,516 | B2 * | 10/2003 | Carballido | 215/230 |
| 6,929,136 | B2 * | 8/2005 | Salazar-Leal | 215/230 |

FOREIGN PATENT DOCUMENTS

DE 29610949 U1 10/1997

(Continued)

*Primary Examiner*—Patricia L Nordmeyer
(74) *Attorney, Agent, or Firm*—Townsend and Townsend and Crew, LLP

(57) ABSTRACT

A lid (30) for a disposable beverage container (32). The lid (30) includes at least a region having thermochromic properties which is/are adapted to change color upon reaching a predetermined non-ambient temperature in response to heat transfer from or to contents (40) of the container (32). Also disclosed is a lid (60) including at least one recess (62) having an internal side wall or walls (64) that substantially correspond in size and shape to the external side wall(s) (66) of a container (68). The lid internal side walls (64) are adapted to securely frictionally engage, over substantially their entire surface area, the external side wall(s) (66) of another like container (68).

20 Claims, 9 Drawing Sheets

FOREIGN PATENT DOCUMENTS

| | | | |
|---|---|---|---|
| DE | 29816016 | U | 11/1998 |
| DE | 20002797 | U1 | 8/2000 |
| EP | 0044750 | A2 | 1/1982 |
| GB | 2316385 | A | 2/1998 |
| JP | 10167342 | A | 6/1998 |
| WO | WO 97/27050 | A1 | 7/1997 |

* cited by examiner

LID FOR A DISPOSABLE BEVERAGE CONTAINER

FIELD OF THE INVENTION

The present invention relates to a lid for a disposable beverage container.

The lid has been developed primarily for use with foam or paper cups commonly used in the sale of heated beverages, such as coffee, or chilled beverages, such as soft drinks, and will be described with reference to the former application. However, it will be appreciated that the invention is not limited to this particular use.

BACKGROUND OF THE INVENTION

Numerous beverage lids and associated containers are known.

Some known lids include small printed or embossed warning signs of HOT or the like. However, a disadvantage of known lids and containers is they do not provide an estimated indication of the actual temperature of the contents of the container, particularly to those not handling the container. Such an estimated indication is desirable for many reasons as will be explained below. Examples of two such reasons are improved safety when conveying heated container contents and improved quality control for customers expecting contents of a predetermined temperature.

Lids having recessed outer surfaces for receiving the underside of containers for stacking are also known. However, a disadvantage of such known lids and containers is they do not provide a secure engagement between the lid and container, sufficient to provide safe conveyance of stacked containers with lids.

OBJECT OF THE INVENTION

It is an object of the present invention to substantially overcome or at least ameliorate one or more of the above disadvantages.

SUMMARY OF THE INVENTION

Accordingly, in a first aspect, the present invention provides a lid adapted to indicate sealing integrity with respect to a disposable beverage container, the lid including a skirt adapted to seal against an open end of the container and having thermochromic properties whereby the skirt is adapted to change color upon reaching a predetermined non-ambient temperature in response to heat transfer from or to contents of the container.

In a second aspect, the present invention provides a lid adapted to indicate sealing integrity with respect to a disposable beverage container, the lid including a skirt adapted to seal against an open end of the container and having thermochromic properties whereby the skirt is adapted to change color upon reaching a predetermined non-ambient temperature in response to heat transfer from or to contents of the container, wherein, when the skirt is sealed against substantially all of the container end, the end substantially insulates the skirt from the heat transfer and no color change occurs, thereby visually indicating sealing integrity, and when the lid is not substantially sealed against all of the container end, heat transfer occurs in non-sealed parts of the skirt causing the color change in the non-sealed skirt parts, thereby visually indicating a lack of sealing integrity.

In a third aspect, the present invention provides a lid for a disposable beverage container, the lid being formed from co-extruded inner and outer layers, wherein the outer layer includes at least one region having thermochromic properties, which region(s) is/are adapted to change color upon reaching a predetermined non-ambient temperature in response to heat transfer from or to contents of the container.

In one form, the lid includes a skirt adapted to substantially sealingly engage an open end of the container and the region is the skirt.

The skirt preferably changes from a first color to a second color, of brighter or warmer tones than the first color, when the contents are at the predetermined non-ambient temperature.

In an embodiment, the skirt changes color to a bright red color when the contents are at a predetermined heated non-ambient temperature. The skirt is preferably violet when the contents are below the predetermined heated non-ambient temperature. The predetermined heated non-ambient temperature is preferably about 45° C.

In another embodiment, the skirt changes color to a blue color to indicate the contents are at a predetermined chilled non-ambient temperature. The skirt is preferably violet when the contents are above the predetermined chilled non-ambient temperature. The predetermined chilled non-ambient temperature is preferably about 5° C.

The lid is desirably formed from a plastics material and includes region(s) impregnated or blended with a material having thermotropic properties. The material having thermochromic properties is desirably a thermochromic pigment, resin or the like, most desirably CHROMICOLOR (Trade Mark).

The region(s) form preferably words, symbols or patterns against the remainder of the lid when the contents are at the predetermined non-ambient temperature.

The region(s) are preferably adapted to return to their original color in response to the temperature of the regions falling below the predetermined non-ambient temperature when that temperature is above ambient or rising above the predetermined non-ambient temperature when that temperature is below ambient.

In another form, the lid includes at least two regions having differing thermochromic properties which are each adapted to change to different colors upon reaching differing non-ambient temperatures in response to heat transfer from or to the contents of the container.

In a fourth aspect, the present invention provides a lid for a disposable beverage container, the container having an open end and a closed end defined by an external side wall or walls, the lid including at least one recess having an internal side wall or walls that substantially correspond to the container external side wall(s) in size and shape, wherein the lid internal side walls are adapted to securely frictionally engage, over substantially their entire surface area, the external side wall(s) of another like container.

The lid internal side wall(s) preferably engage the external side wall(s) of the another like container over approximately 5 to 15% of the height of the another like container. More preferably, the lid internal side wall(s) engage the external side wall(s) of the another like container over approximately 10% of the height of the another like container.

The lid internal side wall(s) preferably engage the external side wall(s) of the another like container over approximately 5 to 15 mm of the height of the another like container. More preferably, the lid internal side wall(s) engage the external side wall(s) of the another like container over approximately 10 mm of the height of the another like container.

In an embodiment, the lid includes two recesses each having the internal side wall(s), one of the recesses being adapted to frictionally engage the closed end of another like container and the other of the recesses being adapted to frictionally engage the closed end of another container of smaller or larger size than a like container. In this embodiment, the recess adjacent the container open end is smaller than the recess remote the container open end.

The lid internal side wall(s) of each recess preferably engage the external side wall(s) of the another like container over approximately 2.5 to 7.5% of the height of the another like container. More preferably, the lid internal side wall(s) of each recess engage the external side wall(s) of the another like container over approximately 5% of the height of the another like container.

The lid internal side wall(s) preferably engage the external side wall(s) of the another like container over approximately 2.5 to 7.5 mm of the height of the another like container. More preferably, the lid internal side wall(s) of each recess engage the external side wall(s) of the another like container over approximately 5 mm of the height of the another like container.

The recess(es) is/are desirably substantially cylindrical.

The recess(es) is/are desirably slightly outwardly conical.

The recess(es) desirably each include a flat surface adjacent one end of the side wall(s) adapted to, in use, abut the underside of the another like container closed end.

BRIEF DESCRIPTION OF THE DRAWINGS

Preferred embodiments of the invention will now be described, by way of examples only, with reference to the accompanying drawings.

DETAILED DESCRIPTION OF THE PREFERRED EMBODIMENTS

Figure 1:
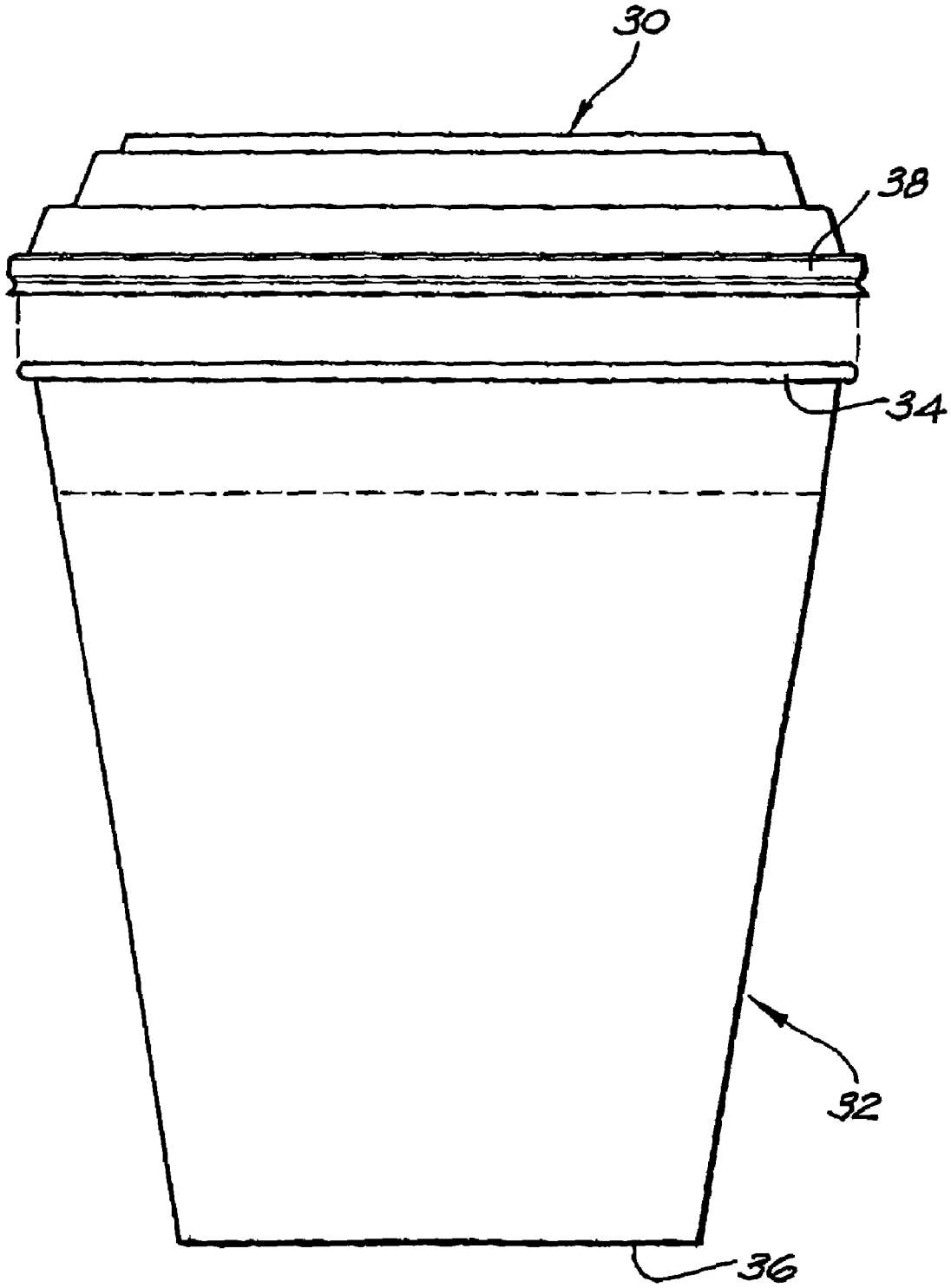
FIG. 1 is a side view of the lid according to a first embodiment of the invention and a correspondingly sized container.
Figure 3:
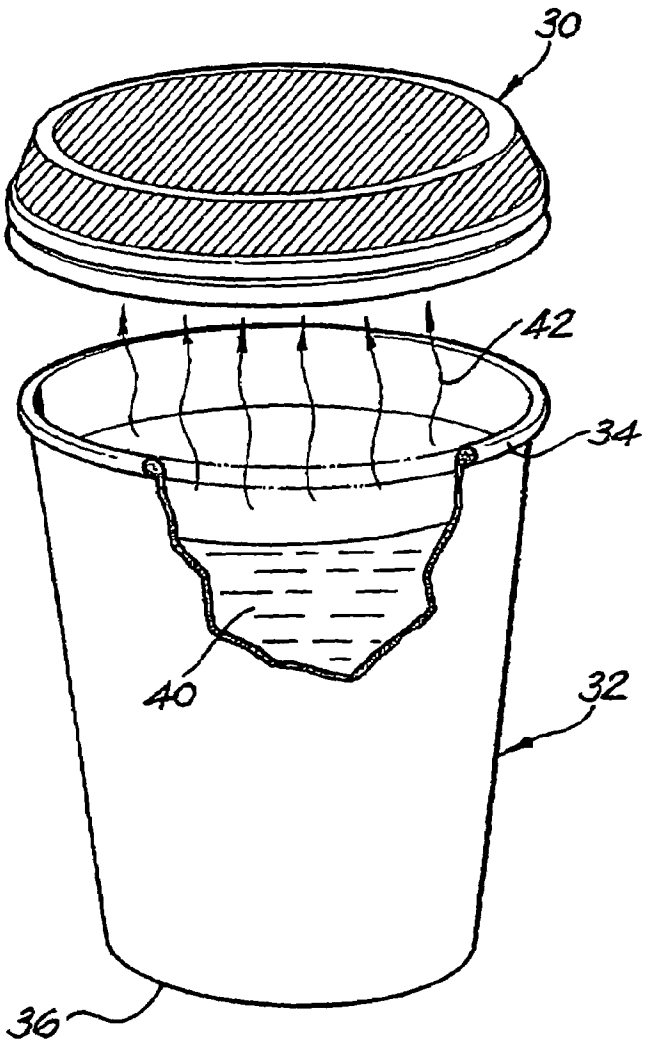
FIG. 3 is a second perspective view of the lid and container shown in FIG. 1.
Figure 2:
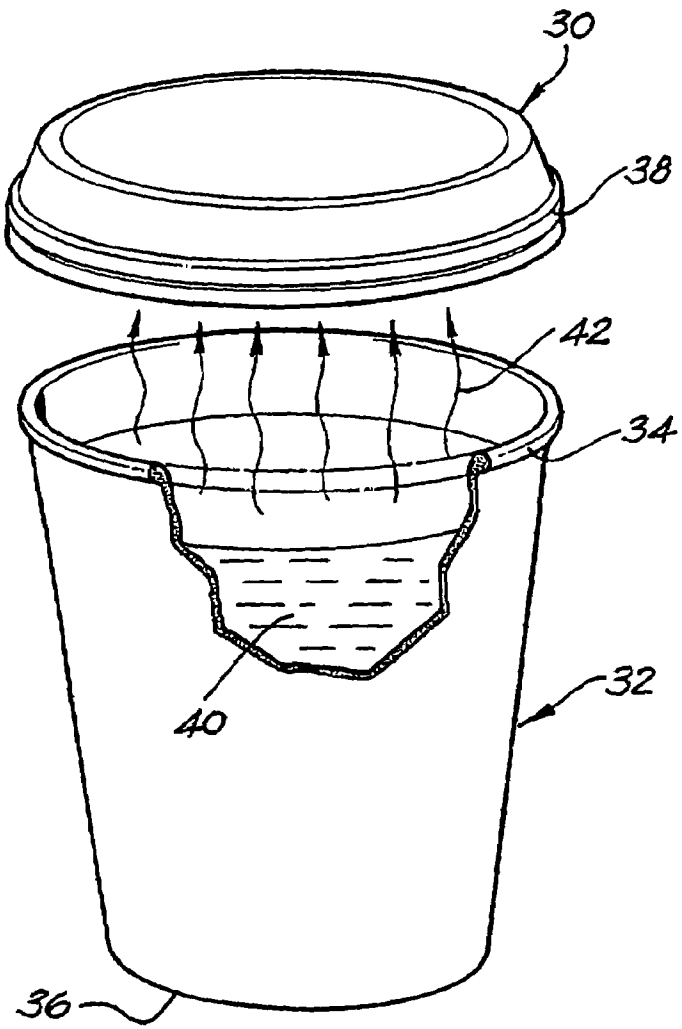
FIG. 2 is a first perspective view of the lid and container shown in FIG. 1.

Referring first to FIGS. 1 to 3, there is shown a lid 30 according to a first embodiment of the invention. The lid 30 is for use with a disposable beverage container, in the form of a polystyrene cup 32, as are commonly used in the sale of coffee. The cup 32 includes an open end surrounded by a circular rim 34 and a closed end defined by a circular flat base 36. The lid 30 includes a peripheral skirt 38 adapted to substantially sealingly engage with the rim 34 of the cup 32, as is well known in the art.

The construction and external shape of the lid 30 are substantially identical to known commercially available high impact polystyrene (HIPS) lids, except the lid 30 also includes therein a material having thermochromic properties, preferably thermochromic pigment, as will be explained in more detail below. Materials having thermochromic properties, including but not limited to thermochromic pigments, are also known. Briefly, materials having thermochromic properties change color (hereinafter referred to as a thermochromic activation color) upon reaching a predetermined temperature (hereinafter referred to as a thermochromic activation temperature). The color change is usually gradual from near the activation temperature and complete by the activation temperature. For example a thermochromic pigment with an activation temperature of 45° C. would begin changing to the thermochromic activation color at about 45° C., with the color change being complete by 45° C.

In use, the cup 32 is filled with contents 40 which, in the present embodiment, would be hot coffee. After the cup 32 has been filled with the hot contents 40, the lid 30 is applied in the known manner to seal the open end of the cup 32 about the rim 34. Heat transfer then occurs between the heated contents 40 and the (ambient temperature) lid 30, as generally indicated by arrows 42. When the heat transfer is sufficient to heat the lid 30 from ambient temperature to a predetermined thermochromic activation temperature of the thermochromic pigment within the lid 30, the thermochromic properties of the pigment cause the lid 30 to change color, as indicated by the shaded portions of the lid shown in FIG. 3. As an example, when the lid 30 is used with cups of hot coffee, a thermochromic pigment is chosen with a thermochromic activation temperature of 45° C. and a thermochromic activation color of bright red.

When used with heated beverages, as described in relation to FIGS. 1 to 3, the lid 30 preferably presents a violet or similar color when at ambient temperature and a bright red color when heated to the thermochromic activation temperature, which provides an intuitive indication that the contents of the cup 32 are hot.

When the contents 40, and thus the lid 30, have cooled to below the thermochromic activation temperature, the lid 30 returns to its original color to indicate that the contents 40 have cooled.

When the cup 32 is to be used with chilled beverages, a thermochromic pigment is selected with a thermochromic activation temperature of, for example, 5° C. and an activation color of blue. When the lid 30 has been chilled to 5° C. due to heat transfer from the (ambient temperature) lid 30 to the chilled contents 40, the lid 30 turns a blue color to indicate that the contents are at the predetermined chilled temperature. Again, when the contents 40, and thus the lid 30, warm to above the thermochromic activation temperature, the lid 30 returns to its original violet color to indicate the contents 40 are no longer chilled.

Figure 4:
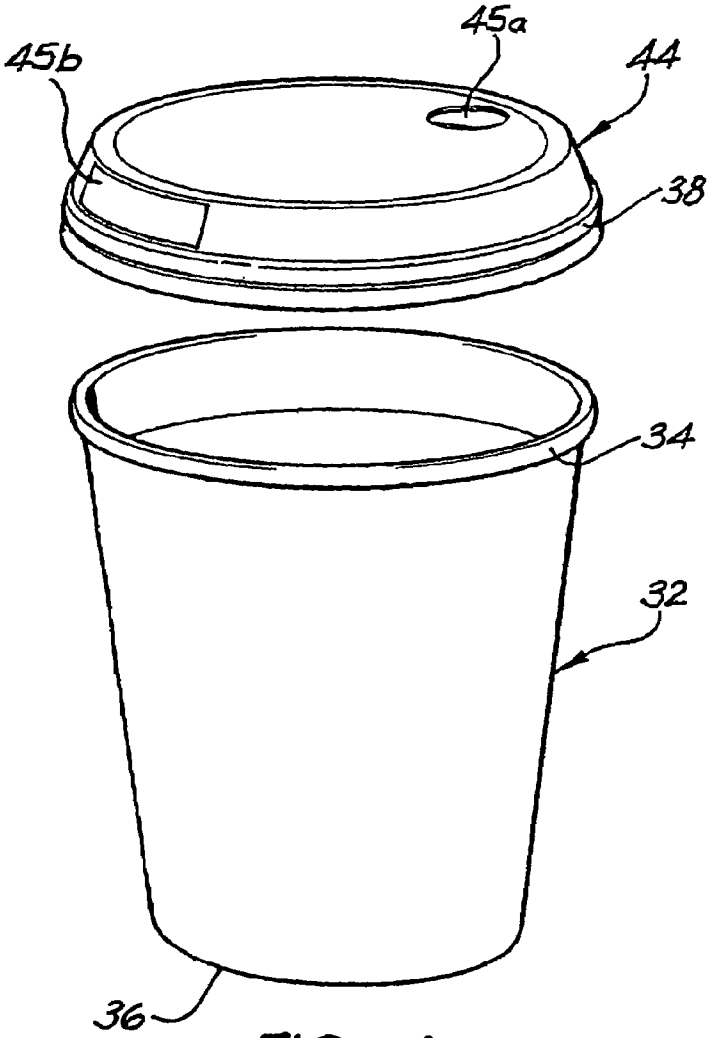
FIG. 4 is a perspective view of a lid according to a second embodiment of the invention and a correspondingly sized container.

FIG. 4 shows a lid 44 according to the second embodiment of the invention, and like reference numerals to those used in describing the first embodiment will be used to denote like features. The lid 44 is similar to the lid 32 according to the first embodiment except it includes an opening 45*a* to allow a user to consume the contents 40 without removing the lid 44 from the cup 32 and an area 45*b* without thermochromic properties to allow advertising, consumer or other information or indicia to be applied to the lid 44.

Figure 5:
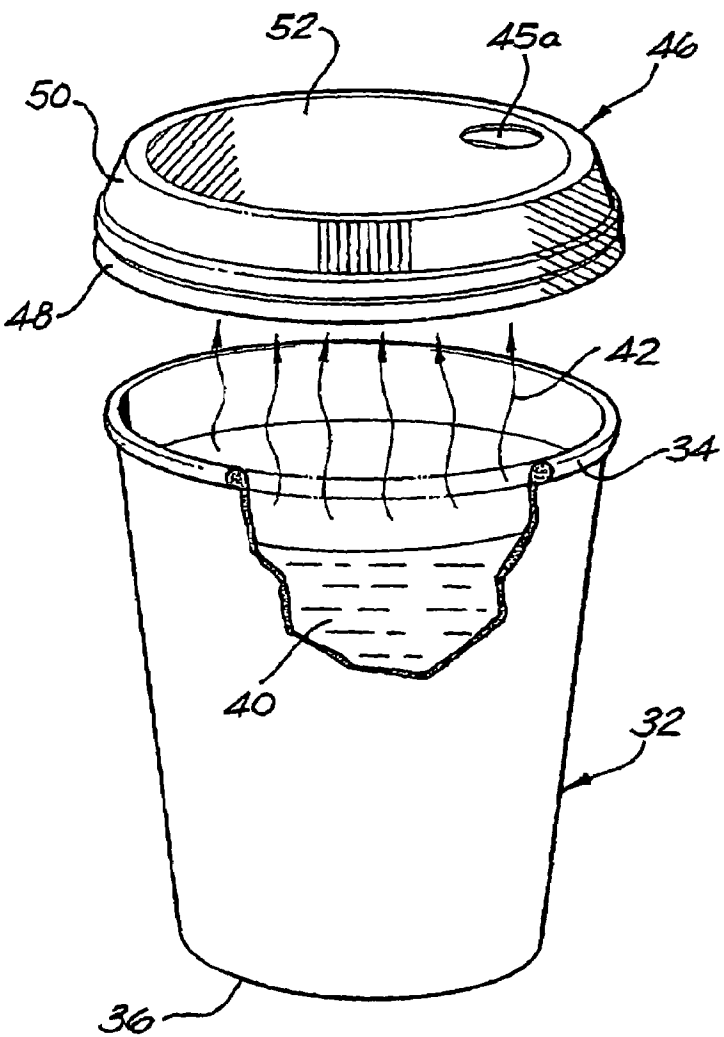
FIG. 5 is a perspective view of a lid according to a third embodiment of the invention and a correspondingly sized container.

FIG. 5 shows a lid 46 according to a third embodiment of the invention, and like reference numerals to those used in describing the first and second embodiments will be used to denote like features. The lid 46 is also similar to the lid 30 according to the first embodiment of the invention except different regions of the lid have been produced using thermochromic pigments of differing activating temperatures so that different parts of the lid, for example rim 48, lid side wall 50 and top 52, can each be configured to change color at differing temperatures (e.g. 40, 45 and 50° C. respectively), to provide a progressive indication of temperature.

FIGS. 6 to 9 show a lid 54 according to a fourth embodiment of the invention, and like reference numerals to those used in describing the previous embodiments will be used to denote like features. The lid 54 is similar to the lid 30 according to the first embodiment of the invention except it has a slightly more raised top surface 56. Importantly, the lid 54 includes the skirt 38 which is adapted to substantially sealingly engage with the rim 34 of the cup 32.

Figure 7:
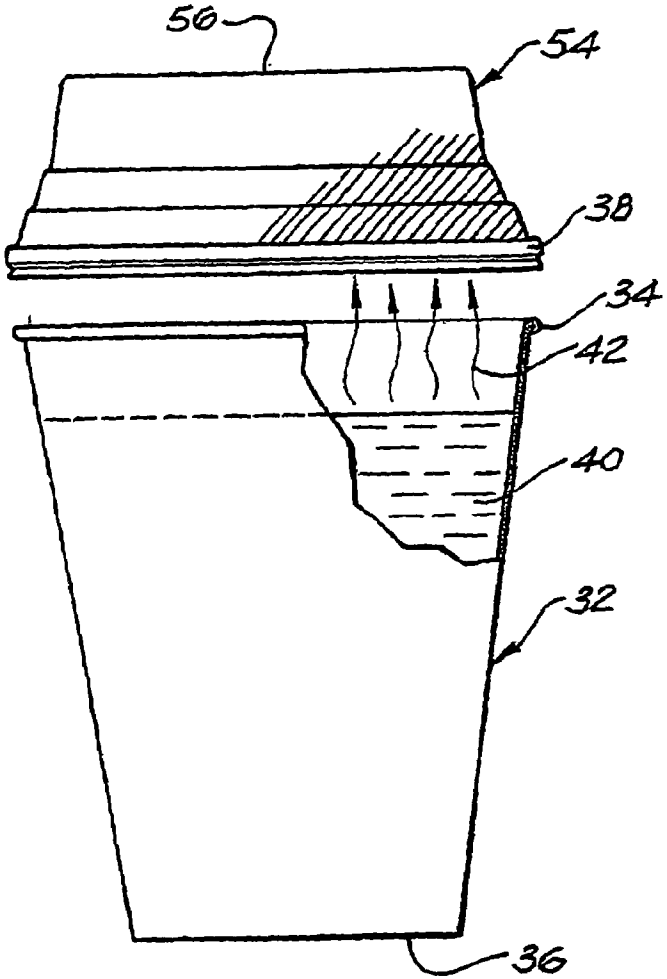
FIG. 7 is a second side view of the lid and container shown in FIG. 6.
Figure 6:
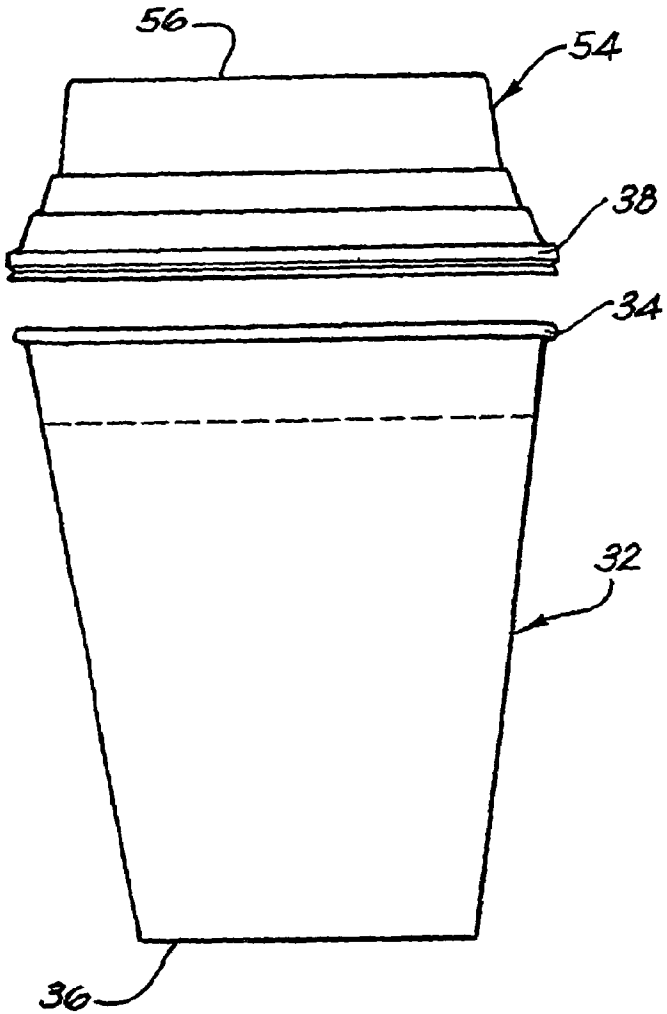
FIG. 6 is a side view of the lid according to a fourth embodiment of the invention and a correspondingly sized container.

As with earlier embodiments, the shaded portion of the lid 54 shown in FIG. 7 demonstrates that the thermochromic pigment in the lid 54 causes it to change color when heat transfer from the contents 40 of the cup 32 causes the lid 54 to reach a predetermined thermochromic activation temperature.

Figure 9:
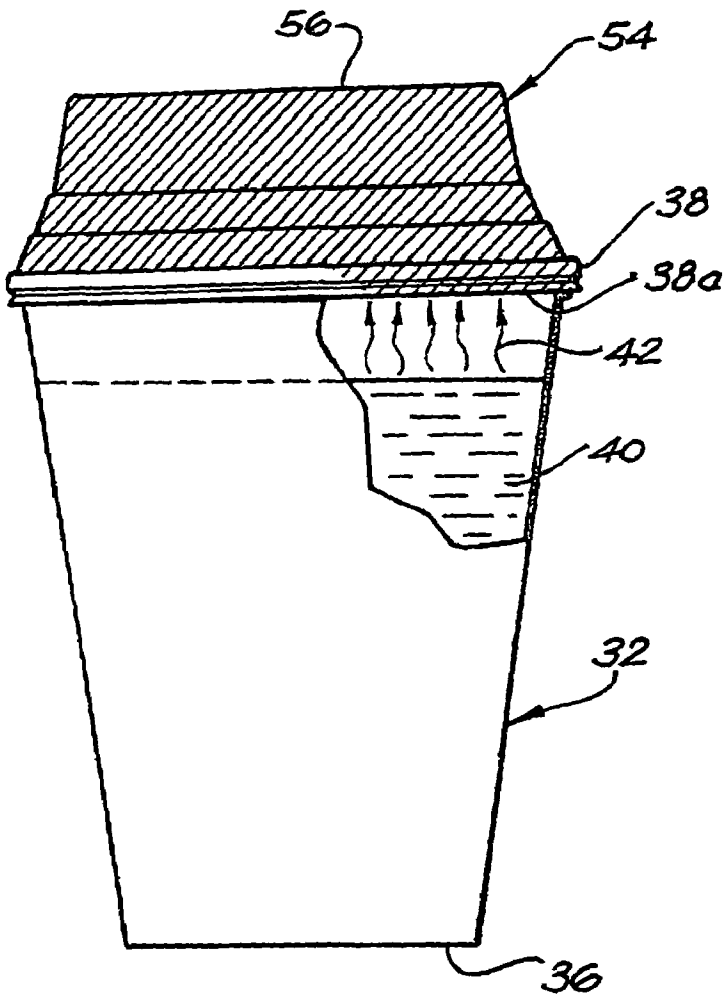
FIG. 9 is a fourth side view of the lid and container shown in FIG. 6.
Figure 8:
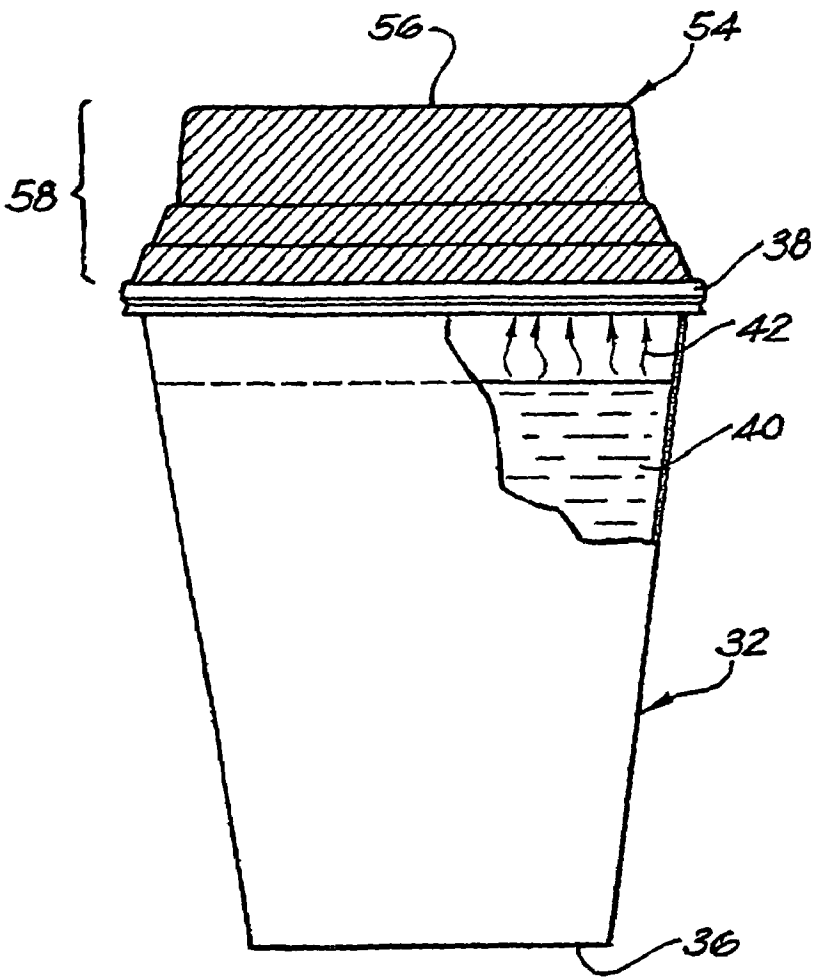
FIG. 8 is a third side view of the lid and container shown in FIG. 6.

FIG. 8 shows the lid 54 and the cup 32 when the lid 54 has been correctly applied to the cup 32 and the skirt 38 covers, and is engaged with, the rim 34 of the cup 32 about its entire periphery. In this position, the rim 34 effectively insulates the skirt 38 from heat transfer with the contents 40 of the cup 32. Accordingly, as shown, only parts 58 of the lid 54 other than the skirt 38 change color upon reaching the predetermined thermochromic activation temperature. However, as shown in FIG. 9, if the skirt 38 is not completely sealed with respect to the rim 34, then hot vapors or similar can pass through the gap between the unsealed portion of the skirt 38 and the rim 34, causing heat transfer and an associated color change in the unsealed portion 38*a* of the skirt 38. Accordingly, applying thermochromic material to all of the lid 54 including the skirt 38, or only the skirt 38, can be used to provide a visual indication as to whether or not the lid 54 is properly sealed with respect to the cup 32, as can occur due to operator error, for avoidance of spillage and the like.

The lid embodiments described above are preferably all molded, particularly vacuum molded, with thermochromic pigments introduced to the molten plastics material (HIPS) before molding. The preferred method of producing the thermochromic regions of the lids involves co-extruding two layers of HIPS. The inner layer (i.e. that adjacent the contents of the cup in use) of HIPS is produced conventionally and with a base pigment of either white or a grey tone to add a depth of color to the lid. The outer layer (i.e. that remote the contents of the cup in use) is produced from a clear HIPS to which has been added approximately 7 to 20%, preferably 10%, by weight of a thermochromic pigment and 2 to 3% of a standard pigment of a similar color to the activated color of the thermochromic pigment. The thermochromic pigments themselves are commercially available from several sources including, for example, those denoted F4, G7 or J8 and sold under the trademark CHROMICOLOR by Matsui International Co. Inc. of Gardena, Calif.

The advantages of the lids according to the embodiments described above are many. For example, the lids can be used in the case of hot beverages to include a warning to the individual with the container, and those they may be approaching, that there are hot and potentially hazardous contents contained therein. In the case of chilled contents, the previously described embodiments of lids provide an indication that the contents have been chilled to a temperature expected by the consumer.

The lids also provide an improved indication of temperature to individuals with reduced eyesight, numbness of the fingers, or those who handle containers in darkened environments.

Figure 10:
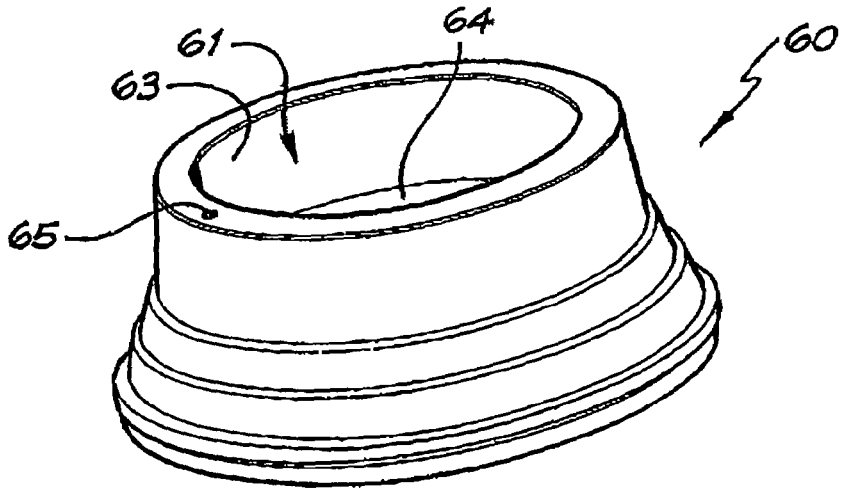
FIG. 10 is a perspective view of a lid according to a fifth embodiment of the invention.
Figure 11:
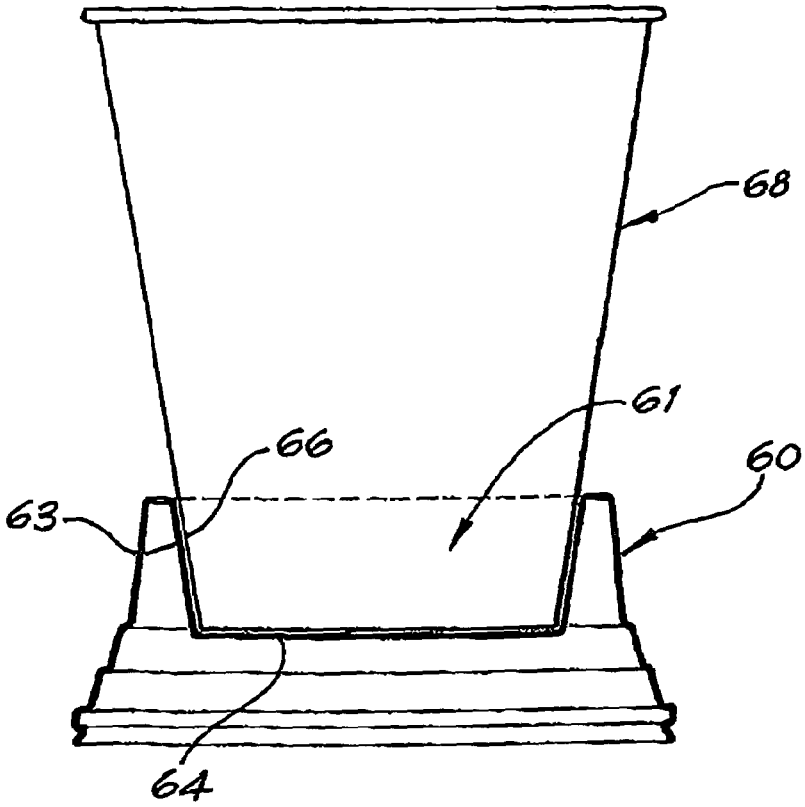
FIG. 11 is a cross-sectional side view of the lid shown in FIG. 10.

FIGS. 10 and 11 show a lid 60 according to a fifth embodiment of the invention. The lid 60 includes a recess 61 having a substantially cylindrical slightwardly outwardly conical internal side wall 63 around a flat surface 64. The lid 60 also includes a vent hole 65, as is well known in the art.

As best shown in FIG. 11, the internal side wall 63 substantially corresponds in size and shape to the external side wall 66 that defines the closed end of an associated container, such as a cup 68. Accordingly, when the closed end of the container 68 is positioned within the recess 61 of the lid 60, the lid internal side wall 63 securely frictionally engages, over substantially its entire surface area, the external side wall 66 of the container 68. More particularly, in relation to a standard volume 8-ounce (237 mls) coffee cup, the side walls 64 and 66 engage over approximately 10 mm (10%) of the height of the container.

Figure 12:
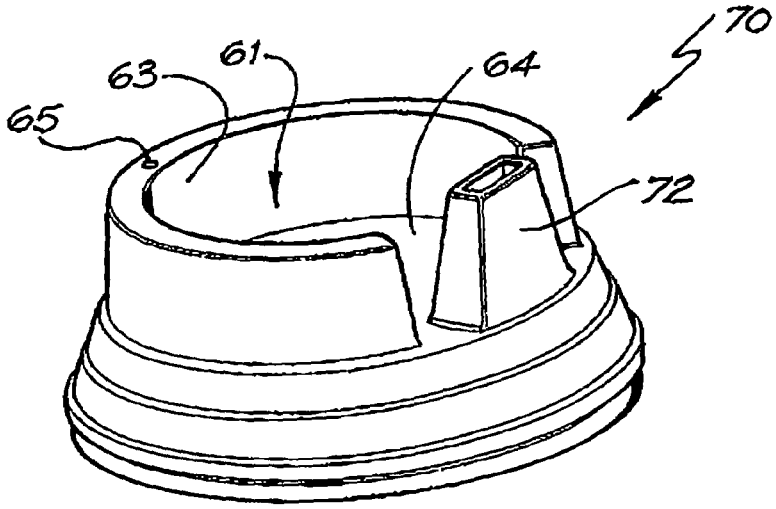
FIG. 12 is a perspective view of the lid according to a sixth embodiment of the invention.
Figure 13:
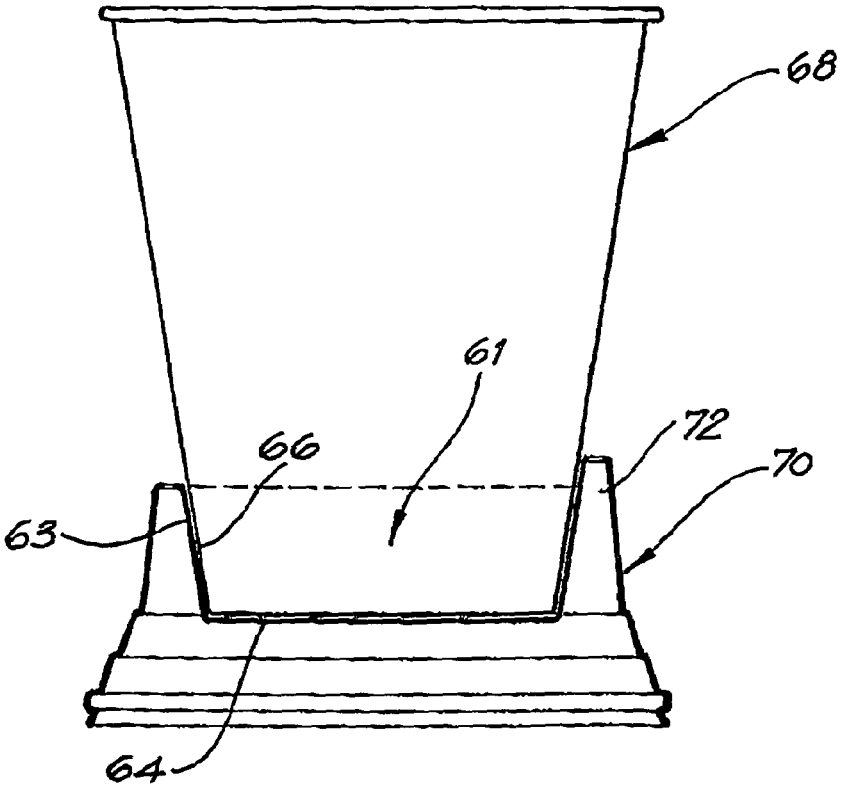
FIG. 13 is a cross-sectional side view of the lid shown in FIG. 12.

FIGS. 12 and 13 show a lid 70 according to a sixth embodiment of the invention, and like reference numerals to those used in describing the fifth embodiment will be used to denote like features. The lid 70 is similar to the lid 60 according to the fifth embodiment except the internal side wall 63 does not extend around the entire lid periphery and instead has a portion removed to allow room for provision of a drinking spout 72.

Figure 14:
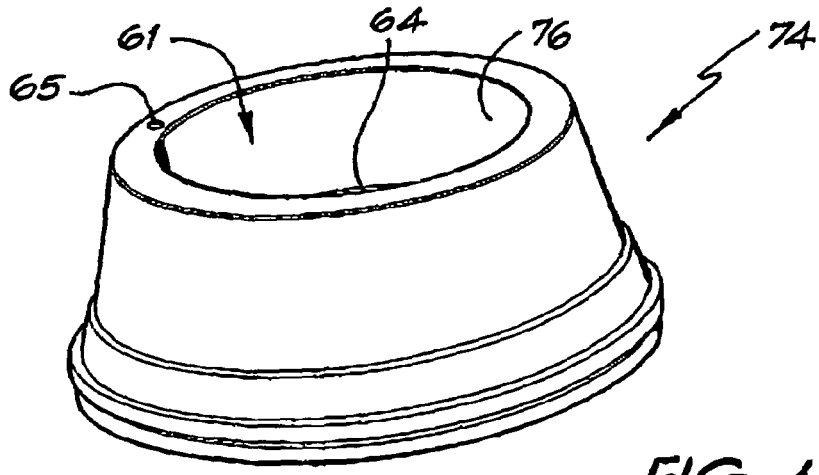
FIG. 14 is a perspective view of the lid according to a seventh embodiment of the invention.

FIG. 14 shows a lid 74 according to a seventh embodiment of the invention, and like reference numerals to those used in describing the fifth and sixth embodiments will be used to denote like features. The lid 74 is substantially identical to the lid 60 according to the fifth embodiment except the recess 61 is deeper and provides a side wall 76 that engages with the external side walls of a corresponding container (not shown) over approximately 20 mm (10%) of the height of the container.

Figure 15:
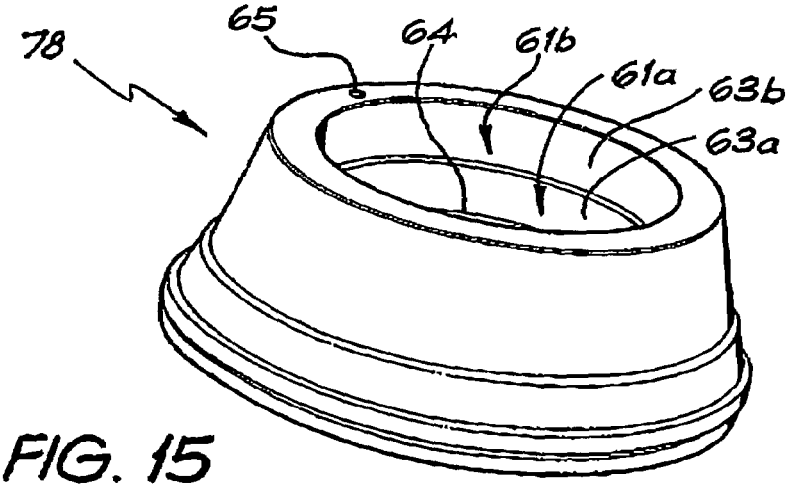
FIG. 15 is a perspective view of the lid according to an eighth embodiment of the invention.
Figure 17:
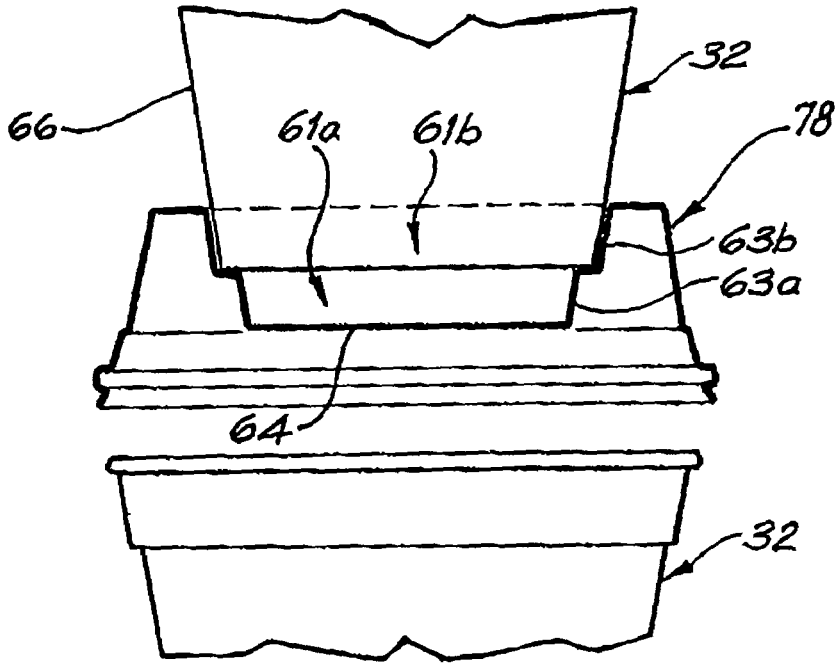
FIG. 17 is a cross-sectional side view of the lid shown in FIG. 15.

FIGS. 15 and 17 show a lid 78 according to an eighth embodiment of the invention, and like reference numerals to those used in describing the fifth to seventh embodiments will be used to denote like features. The lid 78 is substantially identical to the lid 74 of the seventh embodiment except it includes two recesses 61*a* and 61*b* surrounded by respective side walls 63*a* and 63*b*. The recess 61*a* is, in use, adjacent the associated cup's open end and adapted to engage a smaller container compared to the recess 61*b*, which is remote the cup's open end and adapted to engage a relatively larger container. This allows the lid 78 to seal one of either a larger or smaller size cup and have another of the larger or smaller size cup engaged therewith by stacking (larger cup 32 shown).

Figure 16:
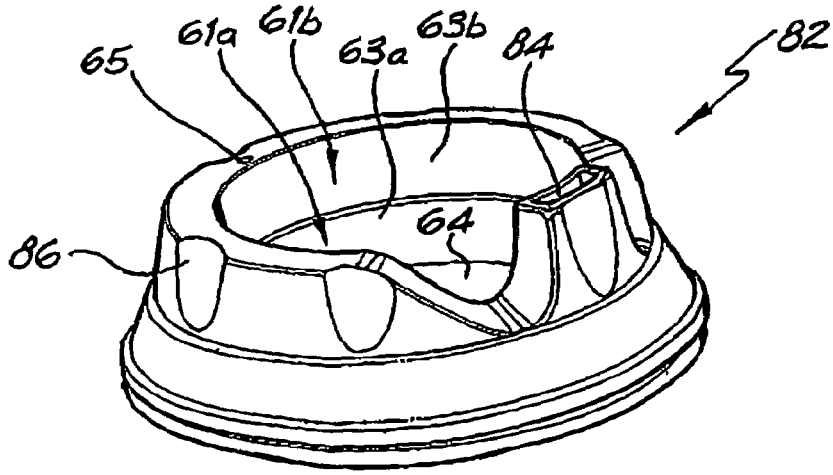
FIG. 16 is a perspective view of the lid according to a ninth embodiment of the invention.

FIG. 16 shows a lid 82 according to a ninth embodiment of the invention, and like reference numerals to those used in describing the fifth to eighth embodiments will be used to denote like features. The lid 82 is substantially identical to the lid 78 of the eighth embodiment except it includes a drinking spout 84 and external depressions 84, which serve to increase the structural rigidity of the lid 82.

Figure 18:
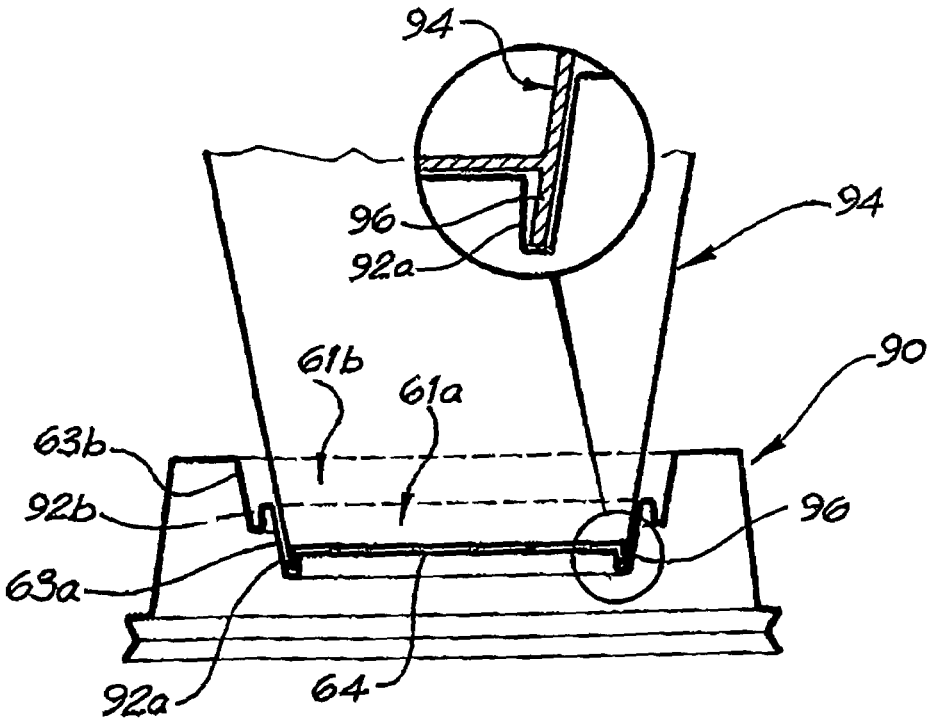
FIG. 18 is a cross-sectional side view of the lid according to an tenth embodiment of the invention.

FIG. 18 shows a lid 90 according to an tenth embodiment of the invention, and like reference numerals to those used in describing the fifth to ninth embodiments will be used to denote like features. The lid 90 is for use with a paper cup 94 and is substantially identical to the lid 86 of the ninth embodiment except the lower edges of the recesses 61*a* and 61*b* continue as grooves 92*a* and 92*b* respectively, which serve to receive and engage a peripheral edge 96 on the underside of the paper cup 94. The lid 90 is shown engaged with a smaller cup.

The main advantage of the lids according to the fifth to twelfth embodiments of the invention is that they provide a secure gripping engagement with the underside of a correspondingly sized container, such that when the lids are secured to a primary container they can be engaged with a secondary stacked container in a secure fashion to provide for ease of carrying multiple stacked containers.

Although the invention has been described with reference to specific examples, it will be appreciated to those skilled in the art that the invention may be embodied in many other forms. Particularly, the thermochromic features of the first five embodiments can be incorporated with the stacking features of the sixth to twelfth embodiments and vice versa.

The invention claimed is:

1. A disposable beverage container with a lid, the container comprising a closed end from which a side wall or side walls extend to an open end surrounded by a circular rim, and the lid comprising:

a peripheral skirt comprising a circular part from which an outwardly flared part depends, the circular part of the peripheral skirt sealingly engaging with the circular rim, the outwardly flared depending part of the peripheral skirt not being in contact with and being spaced away from any part of the container;

at least a region having thermochromic properties which is adapted to change color upon reaching a predetermined heated non-ambient temperature in response to heat transfer from or to the contents of the container; and thermochromic material applied either to all of the lid including the skirt, or only to the skirt, to provide the thermochromic properties whereby the color of the skirt provides a visual indication as to whether or not the lid is properly sealed with respect to the beverage container.

2. A disposable beverage container with a lid as claimed in claim 1, wherein the lid is formed of plastics material, and the plastics material of all of the lid including the skirt, or of only the skirt, has been impregnated or blended with a material having thermochromic properties.

3. A disposable beverage container with a lid as claimed in claim 2, wherein the material having thermochromic properties is a thermochromic pigment or resin.

4. A disposable beverage container with a lid as claimed in claim 3, wherein the material having thermochromic properties is CHROMICOLOR™.

5. A disposable beverage container with a lid as claimed in claim 1, wherein the region having thermochromic properties is arranged to return to its original color in response to the temperature of the region falling below the predetermined non-ambient temperature.

6. A disposable beverage container with a lid as claimed in claim 1, wherein the lid is formed from a co-extruded outer and inner layer and the thermochromic material to provide the thermochromic properties is only applied in the outer layer.

7. A disposable beverage container with a lid as claimed in claim 1, wherein the region having thermochromic properties changes from a first color to a second color, which is of brighter or warmer tones than the first color, when the contents are at the predetermined non-ambient temperature.

8. A disposable beverage container with a lid as claimed in claim 7, wherein the region changes to a bright red color when the contents are at the predetermined heated non-ambient temperature.

9. A disposable beverage container with a lid as claimed in claim 8, wherein the region is violet when the contents are below the predetermined heated non-ambient temperature.

10. A disposable beverage container with a lid as claimed in claim 7, wherein the predetermined heated non-ambient temperature is approximately 45° C.

11. A lid for a disposable beverage container, the container comprising a closed end from which a side wall or side walls extend to an open end surrounded by a circular rim, the lid comprising:

a peripheral skirt comprising a circular part from which an outwardly flared part depends, the circular part of the peripheral skirt sealingly engaging with the circular rim, the outwardly flared depending part of the peripheral skirt not being in contact with and being spaced away from any part of the container;

at least a region having thermochromic properties which is adapted to change color upon reaching a predetermined heated non-ambient temperature in response to heat transfer from or to the contents of the container; and thermochromic material applied either to all of the lid including the skirt, or only to the skirt, to provide the thermochromic properties whereby the color of the skirt provides a visual indication as to whether or not the lid is properly sealed with respect to the beverage container.

12. A lid as claimed in claim 11, wherein the lid is formed of plastics material, and the plastics material of all of the lid including the skirt, or of only the skirt, has been impregnated or blended with a material having thermochromic properties.

13. A lid as claimed in claim 12, wherein the material having thermochromic properties is a thermochromic pigment or resin.

14. A lid as claimed in claim 13, wherein the material having thermochromic properties is CHROMICOLOR™.

15. A lid as claimed in claim 11, wherein the region having thermochromic properties is arranged to return to its original color in response to the temperature of the region falling below the predetermined non-ambient temperature.

16. A lid as claimed in claim 11, wherein the lid is formed from a co-extruded outer and inner layer and the thermochromic material to provide the thermochromic properties is only applied in the outer layer.

17. A lid as claimed in claim 11, wherein the region having thermochromic properties changes from a first color to a second color, which is of brighter or warmer tones than the first color, when the contents are at the predetermined non-ambient temperature.

18. A lid as claimed in claim 17, wherein the region changes to a bright red color when the contents are at the predetermined heated non-ambient temperature.

19. A lid as claimed in claim 18, wherein the region is violet when the contents are below the predetermined heated non-ambient temperature.

20. A lid as claimed in claim 17, wherein the predetermined heated non-ambient temperature is approximately 45° C.

* * * * *